US011548678B2

(12) United States Patent
Dabrowski et al.

(10) Patent No.: US 11,548,678 B2
(45) Date of Patent: Jan. 10, 2023

(54) CONTAINER BOTTOM BASE PROVIDED WITH A BI-CONCAVE ARCH

(71) Applicant: SOCIETE DES PRODUITS NESTLE S.A., Vevey (CH)

(72) Inventors: Nicolas Dabrowski, Vittel (FR); Vincent Teniere, Saint Die des Vosges (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 16/621,068

(22) PCT Filed: Jun. 7, 2018

(86) PCT No.: PCT/EP2018/065038
§ 371 (c)(1),
(2) Date: Dec. 10, 2019

(87) PCT Pub. No.: WO2018/228921
PCT Pub. Date: Dec. 20, 2018

(65) Prior Publication Data

US 2020/0198827 A1 Jun. 25, 2020

(30) Foreign Application Priority Data

Jun. 12, 2017 (EP) ..... 17175542

(51) Int. Cl.
*B65D 1/02* (2006.01)

(52) U.S. Cl.
CPC .... *B65D 1/0284* (2013.01); *B65D 2501/0036* (2013.01)

(58) Field of Classification Search
CPC ..... B65D 1/0284; B65D 1/0261; B65D 2501/0036
(Continued)

(56) References Cited

U.S. PATENT DOCUMENTS 3,935,955 A 2/1976 Das
2011/0049083 A1* 3/2011 Scott ..... B65D 1/0276 215/371
(Continued)

FOREIGN PATENT DOCUMENTS

CN 1049006 A 2/1991
CN 103025614 A 4/2013
(Continued)

OTHER PUBLICATIONS

Espacenet English Translation of WO 2016186159, Nov. 2016.*
(Continued)

*Primary Examiner* — Ernesto A Grano
(74) *Attorney, Agent, or Firm* — K&L Gates LLP

(57) ABSTRACT

A container (1) made of plastic having a main axis (X) being provided with a body (5) and a bottom base (6) extending from a lower end of the body (5), the bottom base (6) comprising: •—a peripheral seat (7) defining a laying plane (8); •—a concave arch (10) which extends from the periphery of a central zone (11) of the bottom base (6) to the peripheral seat (7), said concave arch (10) having a rounded general shape with a concavity turned towards the outside of the container (1); •—a series of principal reinforcing grooves (13) which extend radially from the central zone (11) to at least the peripheral seat (7). The concave arch (10) has two annularly tangentially continuous concentric regions, i.e. a central region (15) and a peripheral region (16), said annularly tangentially concentric regions being in continuity with each other and presenting two different radius of curvature, the peripheral region (16) having a radius of curvature smaller than the one of the central region (15).

17 Claims, 5 Drawing Sheets

SECTION A-A

(58) Field of Classification Search
USPC ..... 215/371; 220/608
See application file for complete search history.

(56) References Cited

U.S. PATENT DOCUMENTS

| | | | | |
|---|---|---|---|---|
| 2014/0175043 | A1 | 6/2014 | Haner et al. | |
| 2015/0136727 | A1 | 5/2015 | Hermel | |
| 2015/0259090 | A1 * | 9/2015 | Dornbach | B65D 1/0261 215/371 |

FOREIGN PATENT DOCUMENTS

| | | | | |
|---|---|---|---|---|
| CN | 110053842 | A | 7/2019 | |
| EP | 2133277 | A1 * | 12/2009 | B65D 1/0284 |
| JP | 2016108048 | A | 6/2016 | |
| WO | 2014083255 | A1 | 6/2014 | |
| WO | WO-2016186159 | A1 * | 11/2016 | B65D 1/0284 |
| WO | WO-2018065691 | A * | 4/2018 | B65D 1/0284 |
| WO | WO-2018065691 | A1 * | 4/2018 | B65D 1/0284 |

OTHER PUBLICATIONS

Espacenet English Translation of WO 2018065691, Apr. 2018.*
Espacenet English Translation of EP 2133277, Dec. 2009.*
China Patent Office Communication for Application No. 201880037354.X, dated Mar. 5, 2021, 5 pages.
Japan Patent Office Communication for Application No. 2019-568390, Dispatch No. 200121, Dispatch Date May 10, 2022, 5 pages.

* cited by examiner

SECTION A-A

CONTAINER BOTTOM BASE PROVIDED WITH A BI-CONCAVE ARCH

CROSS REFERENCE TO RELATED APPLICATIONS

The present application is a National Stage of International Application No. PCT/EP2018/065038, filed on Jun. 7, 2018, which claims priority to European Patent Application No. 17175542.4, filed on Jun. 12, 2017, the entire contents of which are being incorporated herein by reference.

FIELD OF THE INVENTION

The invention relates to improvements made to containers, in particular bottles or jars, obtainable by blowing, blow-molding or stretch blow-molding of preforms made of thermoplastic material such as PET (polyethylene terephthalate), PE (polyethylene), PEF (polyethylene furanoate) or other suitable thermoplastic material.

BACKGROUND

Manufacturing of containers by blow-molding ordinarily consists of inserting, into a mold with the imprint of the container, a preform previously heated to a temperature above the glass transition temperature of the material, and of injecting into the preform a fluid (particularly a gas such as air but it can also be an incompressible fluid such as water) under pressure. The blowing can be completed by a preliminary stretching of the preform by means of a sliding rod.

The dual molecular orientation (bi-orientation) that the material undergoes during blow-molding (axial and radial, respectively parallel and perpendicular to the general axis of the container) gives a certain structural rigidity to the container.

Such containers have a body extending between, at the top, a neck and, at the bottom, a base adapted for withstanding without marked deformation the hydrostatic pressure due to the liquid column which rises above them.

Containers intended to contain a still liquid (for example bottles intended to contain drinking water) are, in the majority of cases, provided with a rounded bottom base in the general form of a spherical cap having a concavity turned outwards and of relatively small height. Such bases are often provided with substantially radially radiating ribs which are distributed around a central recess, said ribs possibly having various shapes and optionally extending possibly onto the lower part of the wall of the body in order to reinforce the foundation (peripheral zone with which the base rests on a support).

Such bases, in addition to withstanding the hydrostatic pressure due to the liquid column which rises above them, should offer sufficient resistance to withstand any additional stress, even though small, that may be due for example to an internal excess pressure due to storage conditions.

Indeed, when the container is stored in high heat, typically when it is stored on a pallet outdoors in full sun, the temperature of the contents can reach or exceed 50° C., and the increase in pressure caused by the expansion of the contents exceeds the threshold beyond which the base reverses. The container then becomes unstable, with the increased risk of collapse of the whole pallet.

Similarly, when the container is stored in a cooler at temperatures at which the contents freeze, the expansion induced by the solidification may cause the bottom base to reverse, the container thus becoming unstable.

In addition to the above issues, manufacturers of thermoplastic containers such as PET constantly seek to make the containers lighter, which is reflected in, among other things, a lightening of the bases of the containers. For this reason, bottom bases of containers having shapes which were satisfactory a few years ago are no longer suitable, because of the perceptible reduction in the quantity of material used and it is not.

Solutions proposing to increase the mechanical strength of the bottom bases have been envisaged but this artifice, although effective, requires both an increase in material, incompatible with the aforementioned light weighting requirements, and a high blowing pressure reducing thereby the blowability (i.e. the ability of the container to be formed by blowing) of the container.

Manufacturers have been working for several years to find the best compromise between lightweight, rigidity and resistance of the containers. One option is to work on the optimization of the structure and geometry of the container's base.

Therefore, a first objective of the present invention is to propose a container for which the optimized structure and geometry of the base gives it a good compromise between blowability, lightness and rigidity.

A second objective is to propose a container, the base of which offers good resistance to reversal, denting (nonreversible local deformation) and palletization, and which, under high conditions of pressure and/or internal volume, remains stable.

SUMMARY OF THE INVENTION

In this respects, the invention provides a container according to claim 1, said container being made of plastic and comprising a body and a bottom base in which the bottom base has a concave arch presenting two annularly tangentially continuous concentric regions, one of said region having a radius of curvature smaller than the other one.

Indeed, the bottom base of the container of the invention comprises a peripheral seat defining a laying plane; a concave arch which extends from the periphery of a central zone of the bottom base to the peripheral seat, said concave arch having a rounded general shape with a concavity turned towards the outside of the container; and a series of principal reinforcing grooves which extend radially from the central zone to at least the peripheral seat. According to the invention, the concave arch has two annularly tangentially continuous concentric regions, i.e. a central region and a peripheral region, said annularly tangentially concentric regions being in continuity with each other and said regions presenting two different radius of curvature, the peripheral region having a radius of curvature smaller than the one of the central region.

The proposed bottom base makes it possible to propose bottles having higher performances than tested bottles currently on the market. Said higher performances include resistance to denting, resistance to internal pressure and pallets stability.

Various additional structural characteristics can be provided to the bottom base of the claimed container. These additional characteristics can be provided alone or in combination.

For instance the central region of the concave arch has a height that is defined as the height between the laying plane and the virtual intersection of the central region of the concave arch and the main axis of the container.

More specifically, said height of the central region of the concave arch may be comprised within the range from 3 mm to 10 mm.

According to a further feature, the central region of the concave arch has a radius of curvature having its center on the main axis of the container.

In addition to the previous characteristics, the radius of the peripheral region of the concave arch is comprised within the range from 3 mm to 8 mm. The center of the circle presenting said radius may not be centered on the seating plane.

This peripheral region of the concave arch participates to increasing the rigidity of the bottom base for small internal pressures induced by heat during storage or transportation.

In a particular way, the peripheral seat of the bottom base of the container of the invention comprises a width comprised within the range from 0.7 mm to 5 mm. These value of the peripheral seat width are smaller than usual values encountered in bottom base of the art. This feature participates to the resistance of the bottom base to reversal due to internal pressure.

According to a possible option, the principal reinforcing grooves of the bottom base have a curvature that is tangentially continuous and concentric to the central and peripheral regions of the concave arch.

This type of arrangement allows having better performances than the current tested bottom bases for a 5 mm deflection top load test. The performance are improved by 10 to 15%.

It also improves the denting resistance and pressure resistance for example, for a pressure up to 1 bar.

As an additional characteristic, the principal reinforcing grooves have a depth comprised within the range from 1.5 mm to 3.5 mm.

The principal reinforcing grooves with the proposed depth allow to push the boundaries of rupture of the grooves when pressure is applied. Better results in comparison to the tested bottom base have been obtained with a score of +25%.

According to an additional structural feature the principal reinforcing grooves have an open angle comprised within the range from 40° to 80°.

According to a further possible feature, the bottom base of the claimed container comprise intermediate reinforcing grooves which are each interposed between two principle reinforcing grooves.

The use of intermediate reinforcing grooves allows diminishing the surface with flat structure on the base thereby reinforcing the bottom base of the container to resist pressure and denting.

As a possible arrangement, the intermediate reinforcing grooves extend from the central region of the concave arch to at least the peripheral seat.

The fact that the bottom base comprises a fully structured surface contributes to avoiding reversal of the bottom base and to resisting to pressure.

As a further option, the principal and/or intermediate reinforcing grooves extend locally over the peripheral seat and rise up over the bottom base of the container to the body of the container.

This feature allows having good resistance to lateral denting.

More specifically, the principal and/or intermediate reinforcing grooves rise up to the body of the container to a height comprised within the range from 9 to 15 mm with respect to the laying plan.

As a further characteristic of the claimed container, it can be mentioned that the central zone has a semi spherical shape having a radius of 8 to 15 mm centered on the container axis and has a height with respect to the laying plan comprised within the range from 6 to 16 mm.

The central zone with the proposed radius dimensions enables to shatter the amorphous material located at the bottom end of the preform during the blow-molding process and hence participate to a better repartition of the plastic material during the bi orientation operation (stretching and blowing). This has direct effect to the score obtained during the drop tests made on the container.

Various additional characteristics to the one presented can be provided, alone or in combination with the proposed claimed features.

BRIEF DESCRIPTION OF THE DRAWINGS

The invention is further described with reference to the following examples. It will be appreciated that the invention as claimed is not intended to be limited in any way by these examples.

Embodiments of the present invention will now be described, by way of examples, with reference to the accompanying figures in which.

DETAILED DESCRIPTION

As used in this specification, the words "comprises", "comprising", and similar words, are not to be interpreted in an exclusive or exhaustive sense. In other words, they are intended to mean including, but not limited to.

Any reference to prior art documents in this specification is not to be considered as an admission that such prior art is widely known or forms part of the common general knowledge in the field.

Figure 1:
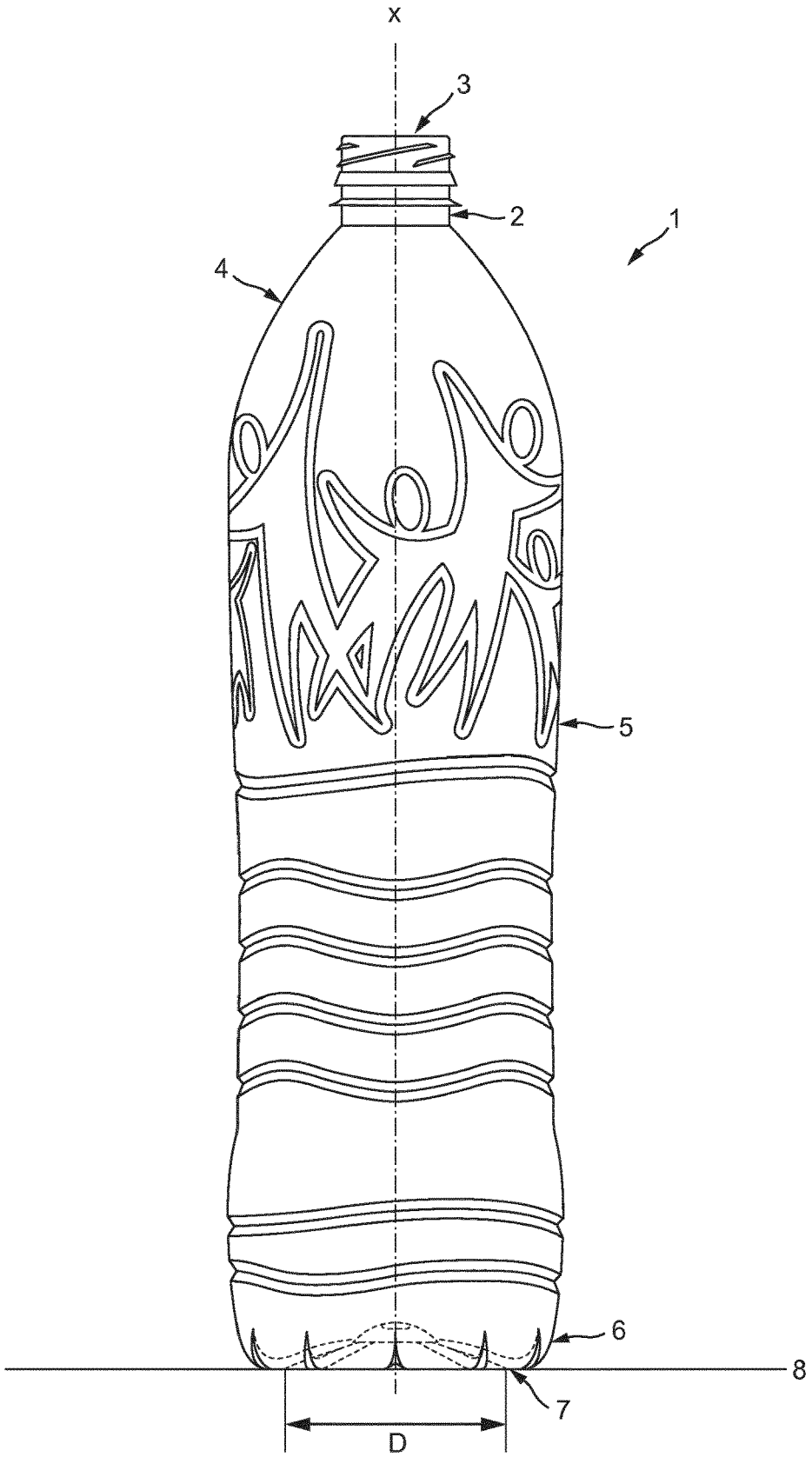
FIG. 1 is a general view of a container made of plastic.

FIG. 1 shows a general view of a container 1, a bottle in this instance, produced by stretch blow-molding of a preform made of thermoplastic material, for example PET (polyethylene terephthalate) or PEF (polyethylene-furanoate).

Said container 1 comprises, at an upper end, a neck 2, provided with a mouth 3. In the extension of the neck 2, the container 1 comprises in its upper part a shoulder 4 that widens out in the direction opposite to the neck 2, said shoulder 4 being extended by a lateral wall or body 5, of a shape generally cylindrical in revolution around a main axis X of the container 1.

The container 1 further comprises a bottom 6 which extends, opposite the neck 2, from a lower end of the body 5. The bottom 6 comprises a peripheral seat 7 in the form of an annular ridge which extends substantially axially in the extension of the body 5. The seat 7 terminates in a laying plane 8 (also called seating plane) perpendicular to the axis X of the container 1, said seating plane 8 defining the lower end of the container land enabling it to be seated upright on a flat surface.

The peripheral seat 7 comprises a width comprised within the range from 0.7 mm to 5 mm. This width of the peripheral seat 7 is smaller than the usual values of seat width for a bottom base. This specific width of the peripheral seat 7 participate in increasing the resistance of the bottom base 6 to reversal due to pressure. This characteristic is also specifically visible in FIG. 6.

In FIG. 1, D denotes the diameter of the container 1 laying on seating plane 8, the term "diameter" covering not only the case (illustrated) in which the container 1 (and thus the bottom 6) has a circular contour, but also a case in which the container 1 would have a polygonal contour (for example square), in which case the term "diameter" would designate the diameter of the circle in which said polygon is inscribed.

FIGS. 2 to 7 will be jointly described in the following part.

Figure 2:
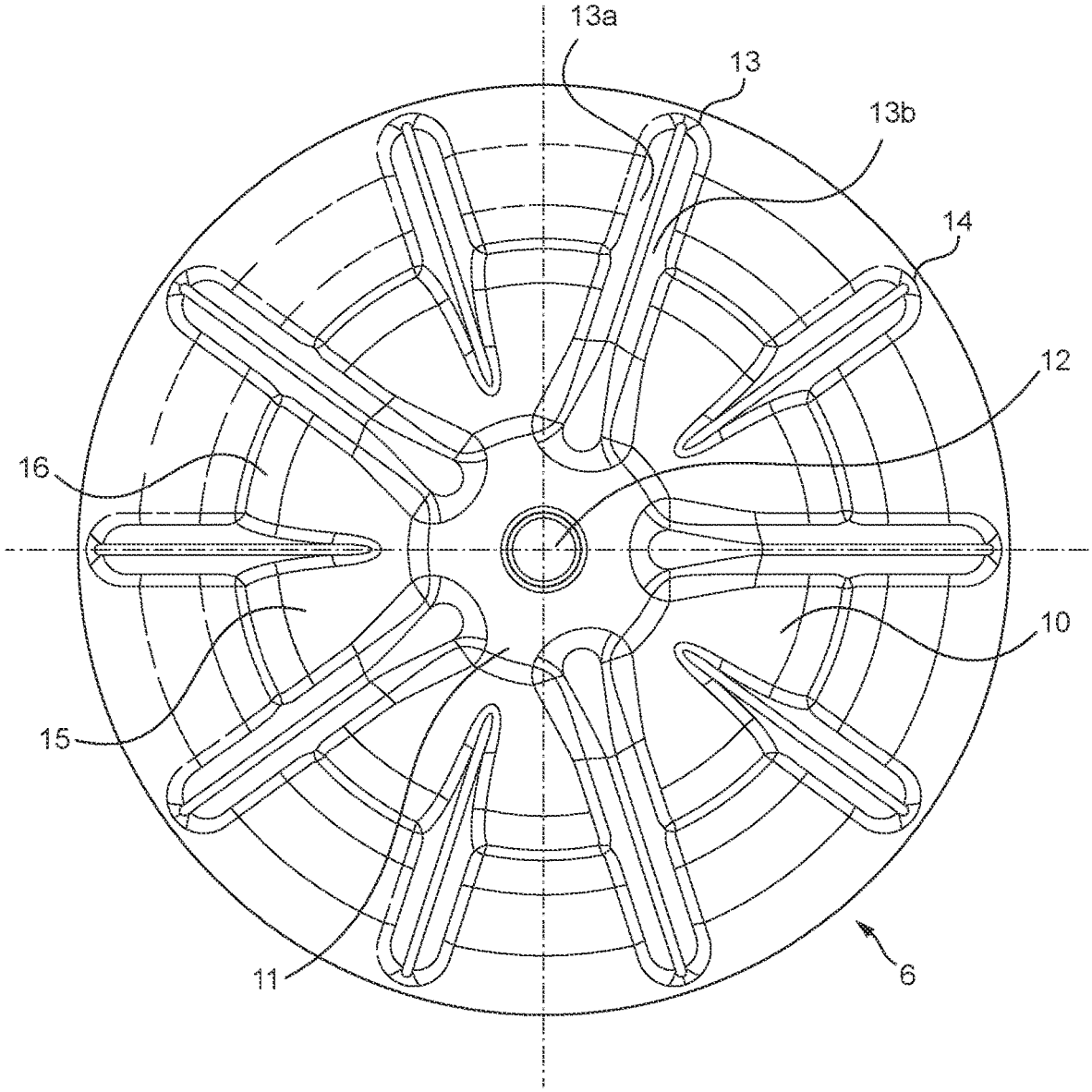
FIG. 2 is a bottom view of the container of FIG. 1 presenting a bottom base according to the invention.
Figure 3:
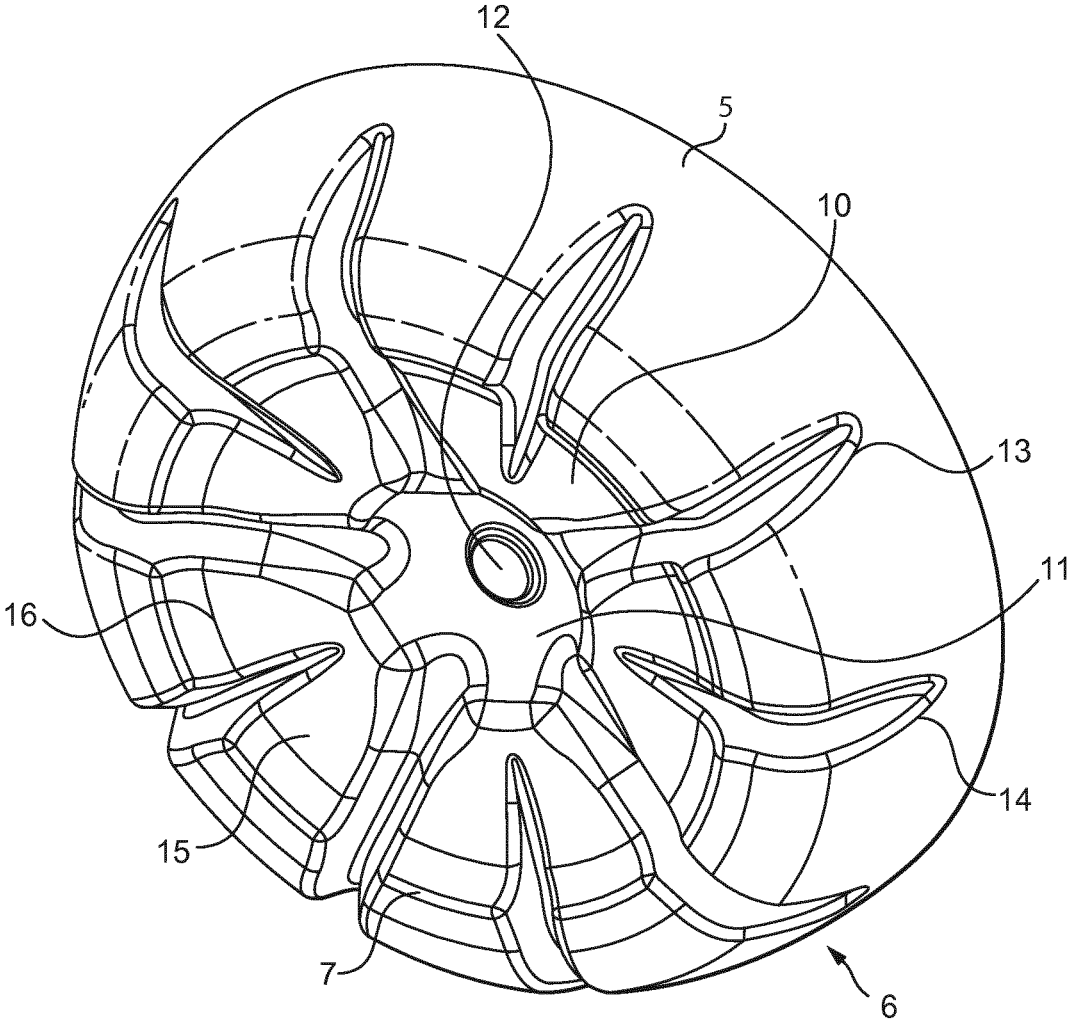
FIG. 3 is a perspective view showing the bottom of the container of FIG. 2.

FIGS. 2 and 3, presenting a bottom view and perspective view of the bottom base of container of FIG. 1 integrating the features of the invention, show the bottom base 6 which comprises from its peripheral part 7 to its center: the peripheral seat 7, already described, a concave arch 10, a central zone 11 also called push up and an amorphous pellet 12 resulting from the formation of the preform and located in its center.

The central zone 11 has a semi spherical shape having a radius of 8 to 15 mm and has a height with respect to the laying plane 8 comprises within the range from 6 to 16 mm.

As already presented, the central zone 11 has the function of participating to a better repartition of the plastic material (especially the amorphous plastic material) in the bottom base during the bi-orientation process.

At the center of the central zone 11 is located the amorphous pellet 12, also called injection point, which corresponds to the zone of injection of the material of the preform used to produce the container and can serve as a centering function during the forming of the container 1 by blowing.

The concave arch 10 has a rounded general shape. It is in the form of a substantially spherical dome with the concavity turned towards the exterior of the container 1 in the absence of stress, i.e. in the absence of contents in the container 1. The arch 10 extends from the seat 7, to the central zone 11 of the bottom 6 forming a boss projecting towards the interior of the container 1.

Figure 4:
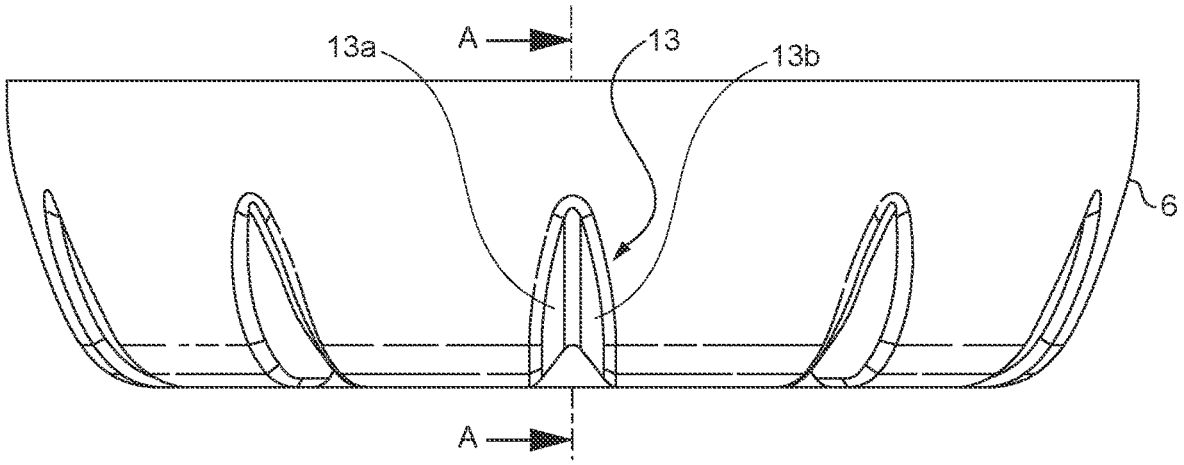
FIG. 4 is an front view of the bottom base of the container of FIGS. 2 and 3.
Figure 6:
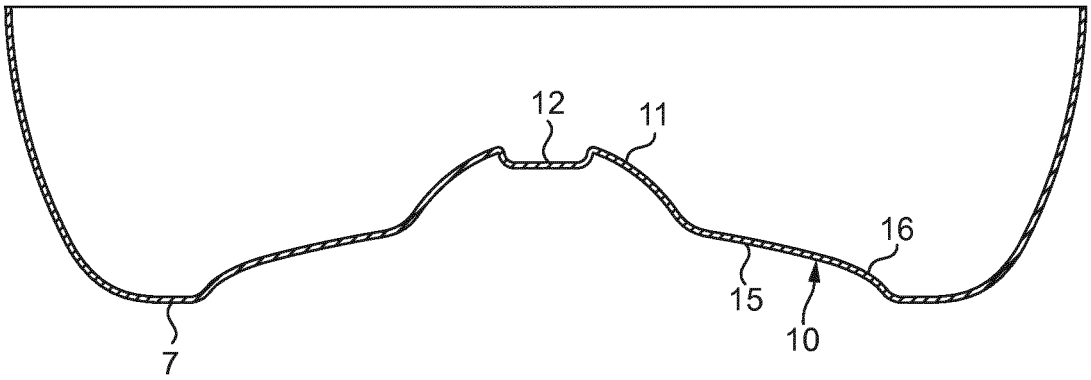
FIG. 6 is a simplified view in cross section of the concave arch of the bottom base of FIGS. 2 and 3.

According to the invention and a visible in the figures, and more particularly in FIGS. 2, 4 and 6, the arch 10 has two annularly tangentially continuous concentric regions. Said two concentric regions are:

an annular central region 15, encircling the central zone 11 of the bottom base 6; and an annular peripheral region 16, encircling the central region 15 and continuous with said central region 15.

The two concentric regions 15 and 16 are annularly tangential and in continuity. They have two different radius of curvature.

As presented in FIG. 6, presenting a simplified view in cross section of the concave arch 10 (without the reinforcing grooves 13 and 14), one can visualize the two concentric regions 15 and 16 in which the peripheral region 16 has a radius of curvature smaller than the one of the central region 15.

The central region 15 of the concave arch 10 has a radius of curvature having its center on the main axis of the container.

The central region 15 of the concave arch has a height that is defined as the height between the laying plane and the virtual intersection of the central region 15 of the concave arch and the main axis X of the container. This height may be comprised within the range from 3 mm to 10 mm.

The radius of curvature of the peripheral region 16 of the concave arch is comprised within the range from 3 mm to 8 mm. The center of the circle presenting said radius may not be centered on the seating plane 8.

The presence of the peripheral region 16, instead of a step as commonly used, allows a better blowability thanks to a better "fingerprinting": during the blowing of the container, the thermoplastic flows better and gets in contact with the mold more easily.

The peripheral region 16 of the concave arch thus participates in rigidifying the bottom base for additional pressure due to heat during storage or transportation.

Under high internal pressure conditions, the content of the container exerts a pressure on the bottom base 6 which tends to collapse. The concave arch 10 with both the central 15 and peripheral 16 regions improve the resistance by inducing a rigidification of the arch concave 10 in its medial region.

In case of pressure becoming too high, the deformation of the bottom base 6 at the location of the concave arch 10 is limited to the peripheral region 16. The peripheral region 16 will deform towards the laying plane 8 and rejoin the surface of the peripheral seat 7 but the function of the central region 15 of the concave arch 10 is preserved.

As can be seen in the figures, and particularly in FIGS. 2 and 3, the bottom base 6 comprises a series of principle reinforcing grooves 13. Said principal reinforcing grooves 13 are hollow towards the interior of the container 1, and which extend radially from a central zone 11 to at least the peripheral seat 7. According to a preferred embodiment, illustrated in the figures, the principal reinforcing grooves 13 extend beyond the seat 7, rising laterally over a lower part of the body 5 of the container 1.

In other words, the principal grooves 13 extend radially over the entire arch 10, over the peripheral seat 7 and part of the body 5. It will therefore be understood that the seating plane 8 is discontinuous because it is interrupted at each principal groove 13. In the present example, there are five principle grooves 13, but this number could be higher, specifically six or seven for a container with a different volume.

Figure 7:
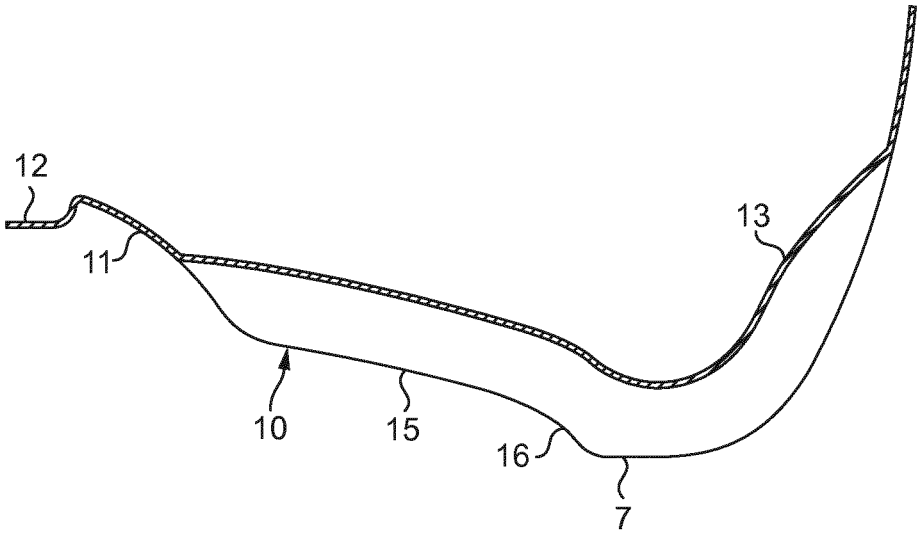
FIG. 7 is a detailed cross section view of the principal reinforcing grooves of the bottom base of FIGS. 2 and 3.

As can be seen on FIG. 7, the principal reinforcing grooves 13 have a curvature that is tangentially continuous and concentric to the central 15 and peripheral 16 regions of the concave arch 10.

The continuity of the mechanical resistance of the principal reinforcing groove is then ensured.

In the present proposed embodiment of the invention, the principal reinforcing grooves 13 have a depth comprised within the range from 1.5 mm to 3.5 mm. The principal reinforcing grooves 13 are formed by first and second principal groove side portions 13*a*, 13*b* (see FIGS. 2 and 4) having and an open angle comprised within the range from 40° to 80°.

The proposed angular range of the open angle ensures a good blowability of the principal reinforcing grooves during the blowing process.

According to a preferred embodiment, the base 6 is further provided with a series of intermediate reinforcing grooves 14 located between the principal grooves 13, and which extend locally over the concave arch 10 such that they also contribute to rigidifying the bottom base 6. As represented in FIGS. 2 and 3, the intermediate reinforcing grooves 14 extend from the central region 15 of the concave arch 10 towards the exterior beyond the peripheral seat 7, rising laterally over a lower part of the body 5, like the principal reinforcing grooves 13.

As another embodiment not represented, the intermediate reinforcing grooves 14 may extend from the central region 15 to the peripheral seat 7 without extending over it.

In the present proposed embodiment of the invention, the intermediate reinforcing grooves 14 are each interposed between two principle reinforcing grooves 13.

Both principal 13 and intermediate 14 reinforcing grooves rise up to the body 5 of the container to a height comprised within the range from 9 to 15 mm with respect to the laying plan 8.

Figure 5:
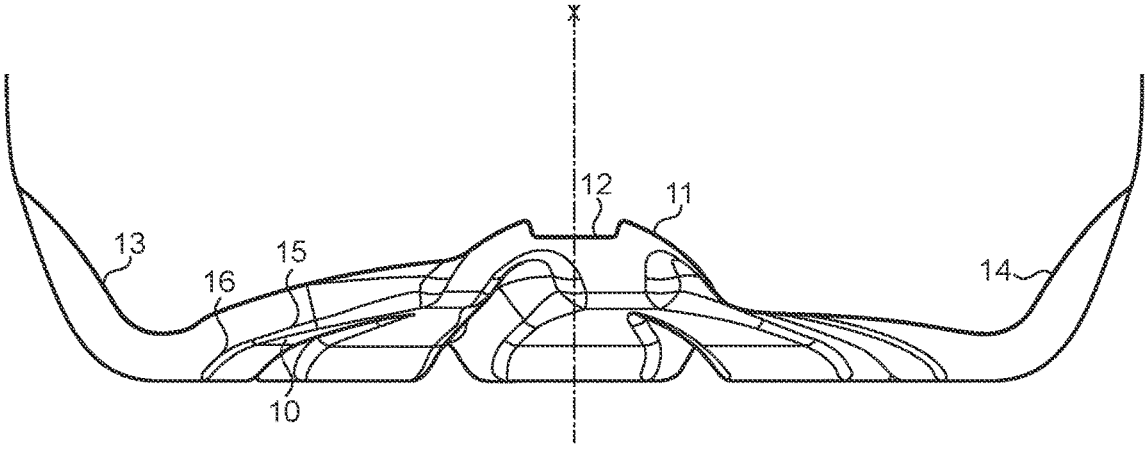
FIG. 5 is a view in cross section along the line A-A, of the bottom base of FIG. 4.

FIG. 5 which is a cross section of the base according to the invention (as presented in FIGS. 2 and 3) along the line A-A for FIG. 4 shows, injection point 12, central zone 11 and concave arch 10 with the concave arch 10 comprising two annularly tangentially continuous concentric regions: central 15 and peripheral 16 regions.

The cross section also shows one of the principal reinforcing grooves 13 and one of intermediate reinforcing grooves 14. The difference in position, geometry and shape of principal reinforcing grooves 13 and intermediate reinforcing grooves 14 is clearly represented.

The container 1 provided with the proposed bottom base 6 offers a good compromise between the mechanical performance (i.e. the ability of the container 1 to resist deformations alone and when palletized and, when they occur, to undergo them in a way that is controlled) and blowability (i.e. the ability of the container 1 to be formed by blowing).

As already mentioned, container and bottle resistance to deformation (reversal and/or denting) and breakage is essential to guarantee product stability and prevent losses during transportation, but also to ensure no negative impact on consumer satisfaction during bottle handling and consumption. In this context the bottom base of the container and bottle plays a critical role, in particular for what concerns bottle stability and resistance.

Comparative Tests on Pallet Stability and Resistance to Denting

The objective of the study is to quantify the impact of bottle base weight and type on the global performance (e.g. resistance) of a 12 g PET cylindrical bottle having a volume of 50 cl as well as on 25.5 g PET cylindrical bottle having a volume of 1.5l.

The tests have been performed on conventional bottle i.e. on bottles that are not considered as lightweight bottle, but, due to the linearity of the performance as a function of plastic weight used to form the bottle, the results obtained in these comparative tests can be extrapolated to lightweight bottom bases.

As for the global performance of the base, attention was particularly drawn on the pallets stability and the resistance to denting during transport was assessed.

Four type of bottom bases were compared: Helium, V3, Base S from the competition, and Proposed base (V4) according to the invention.

Helium, V3 and Base S are bottom bases that are currently on the market.

A complete pallet, with all bottles being produced with the given base was built, For each bottle of the palette, a visual check was assessed on the following features:

lateral deformation and denting, central deformation and denting, bottle was angled, inclined bottle was not standing up anymore, The following table represents the percentages of bottles with defaults in a complete pallet for both tested volumes.

| Base | Lateral Denting | Central Denting | Inclined Bottle | Falling Bottle |
|---|---|---|---|---|
| Helium | 33.6 | 53.1 | 24.9 | 1.3 |
| V4 | 29.4 | 44.9 | 12.3 | 1.0 |
| Base S from competition | 46.7 | 78.9 | 30.0 | 1.8 |
| V3 | 55.4 | 46.0 | 14.4 | 1.3 |

As can be seen in the above table, the proposed bottom base (V4) performs better than the other tested bases for bottles having two different volumes (50 cl and 1.5l) for all tested features. The initially proposed optimization should be fully acknowledge.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

REFERENCES

X container axis
1 Container
2 neck
3 mouth
4 shoulder
5 body
6 bottom base
7 peripheral seat
8 laying plane
9
10 concave arch
11 central zone (push up)
12 amorphous pellet
13 principal reinforcing grooves
14 intermediate reinforcing grooves
15 central region of concave arch
16 peripheral region of concave arch
D Diameter base

The invention claimed is:

1. A container made of plastic and having a main axis, a body, and a bottom base extending from a lower end of the body, the bottom base comprising:

a peripheral seat defining a laying plane;

a concave arch which extends from a periphery of a central zone of the bottom base to the peripheral seat, the concave arch having a rounded shape with a concavity turned towards an outside of the container; and a series of principal reinforcing grooves which extend radially from the central zone to at least the peripheral seat;

the concave arch has an annular central region encircling the central zone of the bottom base and an annular peripheral region encircling the annular central region, wherein the annular peripheral region is continuous with the annular central region, the annular central and peripheral regions being concave in continuity with each other, projecting inward toward an interior of the container, and presenting two different radius of curvature, the annular peripheral region having a radius of curvature smaller than a radius of curvature of the annular central region; and a portion of the bottom base between (i) a periphery of the central zone and (ii) the peripheral seat consists of the annular central region of the concave arch, the annular peripheral region of the concave arch, a portion of each of the series of principal reinforcing grooves, and a portion of each intermediate reinforcing groove, each intermediate reinforcing groove interposed between two of the principal reinforcing grooves.

2. The container according to claim 1, wherein the annular central region of the concave arch has a height that is defined as a distance between the laying plane and a virtual intersection of the annular central region of the concave arch and the main axis of the container.

3. The container according to claim 2, wherein the height of annular central region of the concave arch is within the range of 3 mm to 10 mm.

4. The container according to claim 1, wherein the radius of curvature of the annular central region has a center on the main axis of the container.

5. The container according to claim 1, wherein the radius of curvature of the annular peripheral region of the concave arch is within the range from 3 mm to 8 mm.

6. The container according to claim 1, wherein the peripheral seat comprises a width from 0.7 mm to 5 mm.

7. The container according to claim 1, wherein the series of principal reinforcing grooves have a curvature that is continuous with the annular central and peripheral regions of the concave arch.

8. The container according to claim 1, wherein the series of principal reinforcing grooves have a depth from 1.5 mm to 3.5 mm.

9. The container according to claim 1, comprising intermediate reinforcing grooves, each intermediate reinforcing groove interposed between two principle reinforcing grooves.

10. The container according to claim 9, wherein the intermediate reinforcing grooves extend from the annular central region of the concave arch to at least the peripheral seat.

11. The container according to claim 9, wherein at least one of the principal or intermediate reinforcing grooves extends locally over the peripheral seat and rises up over the bottom base of the container to the body of the container.

12. The container according to claim 9, wherein at least one of the principal or intermediate reinforcing grooves rises up to the body of the container to a height from 9 to 15 mm with respect to the laying plane.

13. The container according to claim 1, wherein the central zone has a semi spherical shape having a radius of 8 to 15 mm and having a height with respect to the laying plane from 6 to 16 mm.

14. The container according to claim 1, wherein the annular central region and the annular peripheral region are continuous along a direction transverse to the main axis of the container.

15. The container according to claim 1, wherein the series of principal reinforcing grooves extend radially through the annular central region and the annular peripheral region of the concave arch.

16. The container according to claim 1, wherein the peripheral seat is discontinuous at each principal reinforcing groove in the series of principal reinforcing grooves.

17. The container according to claim 1, wherein the peripheral seat comprises an annular ridge extending perpendicular to the main axis, and wherein a concavity of the peripheral region of the concave arch projecting inwardly and being in continuity with the annular ridge of the peripheral seat.

* * * * *